US005199753A

United States Patent [19]

Presley, Jr.

[11] Patent Number: 5,199,753

[45] Date of Patent: Apr. 6, 1993

[54] CHILD RESISTANT GATE LATCH

[76] Inventor: Arthur A. Presley, Jr., 5000 Interlachen, Baytown, Tex. 77521

[21] Appl. No.: 823,779

[22] Filed: Jan. 22, 1992

[51] Int. Cl.[5] ..... E05C 1/16

[52] U.S. Cl. ..... 292/188; 292/DIG. 65

[58] Field of Search ..... 292/183, 185, 186, 188, 292/189, 218, DIG. 25, DIG. 65; 70/50, 52, 54, 56, 448, 449

[56] References Cited

U.S. PATENT DOCUMENTS

| | | | |
|---|---|---|---|
| 1,294,009 | 2/1919 | Williams | 292/188 |
| 4,286,809 | 9/1981 | Godwin | 292/54 |
| 4,291,907 | 9/1981 | Berger | 292/188 |
| 4,687,238 | 8/1987 | Mintz | 292/189 X |
| 4,877,276 | 10/1989 | Pastva | 292/218 |

*Primary Examiner*—Richard E. Moore
*Attorney, Agent, or Firm*—Keeling & Associates

[57] ABSTRACT

A child resistant latch having a latch operating assembly comprising a latch operating assembly and a striker bar or keeper plate assembly, one of which is supported on a gate and the other of which is to be supported on a gate post. The latch operating assembly comprises a closed box supported a predetermined distance above the striker bar or keeper plate assembly to permit operation only by an adult or tall child. A locking latch member is supported for vertical movement into and out of latching engagement with the striker bar or keeper plate. A guard box surrounds the striker bar or keeper plate when the latch member is in latching position to prevent opening other than by said operating means. A guide tube extends to a point just above the guard box and has a reciprocally movable rod guided for movement therein which interconnects a key-operated, latch operating lever and the latch member for movement in a vertical direction. A flange is provided on the latch control rod at a desired height for lifting the locking latch from its position atop the striker bar. The latch encasement, length of the control rod, and protective and concealing tubing, serve to prevent the opening of the gate by individuals who cannot reach the flange. An opening is the back wall of the guard box allows the latch control rod to move in and out of the box during opening and closing movement of the gate.

12 Claims, 1 Drawing Sheet

CHILD RESISTANT GATE LATCH

BACKGROUND OF THE INVENTION

1. FIELD OF THE INVENTION

This invention relates to new and useful improvements in gate locking latches and more particularly to a child-resistant gate latch which can be raised only by an individual of sufficient physical stature to qualify for entry to the area secured by the gate latch and further serves to prevent the unauthorized or unqualified entry of an individual to the area secured by the gate latch by the use of levers rods, wires or other mechanisms to open the latch.

2. DESCRIPTION OF THE PRIOR ART

Latching devices for doors, gates and the like which employ a striker bar affixed to the swinging or moving portion of the gate or door and which are mobile only within a horizontal plane together with a locking latch affixed to the stationary portion of the surrounding structure and which locking latch is movable only in the vertical plane have been described in Ausdall U.S. Pat. No. 1,570,195 and Nelson U.S. Pat. No. 4,647,088.

Ausdall U.S. Pat. No. 1,570,195 discloses a latch comprising a striker bar or keeper plate attached to a door above an aperture in the door leading to a cavity therein. The locking latch consists of a notched bar mounted to a stationary surface by a pin which allows the locking latch to pivot axially about the pin in a vertical plane. The door is latched and unlatched by the use of a horizontal lever attached to the locking latch at a right angle which, when moved in a vertical manner, causes the locking latch to rotate axially in a vertical plane thus releasing the door.

Nelson U.S. Pat. No. No. 4,647,088 discloses a fastening device for lading-carrying vehicles such as boxcars for the purpose of deterring pilferage. The latch comprises a striker bar or keeper, a locking latch, a pivot pin and a release member. The striker bar or keeper is attached to a sliding door in a manner such that it can only move in a horizontal plane. The locking latch is mounted to the stationary structure surrounding the door by means of a pivot pin near one end. The locking latch pivots axially abut the pivot pin in a vertical plane. The release member is mounted near the pivot pin and operates like a cam and serves only to prevent access by the use of a pole or other tool.

SUMMARY OF THE INVENTION

One of the objects of this invention is to provide a new and improved gate locking latch.

Another object of the invention is to provide a new and improved gate locking latch which is resistant to opening by small children.

Another object of the invention is to provide a new and improved gate locking latch which is resistant to unauthorized or unqualified opening.

Another object of the invention is to provide a new and improved gate locking latch which is resistant to opening by unauthorized or unqualified individuals by means or levers, wires, or other mechanisms.

Another object of the invention is to provide a new and improved gate locking latch which is resistant to opening by small children and inexpensive to manufacture and easy to install and use.

Other objects of the invention will become apparent from time to time throughout the specification and claims as hereinafter related.

These and other objects of the invention may be accomplished by a gate locking latch which can be raised only by vertically lifting the latch control bar. The control rod is enclosed and concealed within a tubing of sufficient length such that the control rod can only be grasped by an individual of sufficient physical stature to qualify for entry to the area secured by the gate latch. The latch encasement likewise serves to prevent the unauthorized or unqualified entry of an individual to the area secured by the gate latch by the use of levers rods, wires or other mechanisms to open the latch.

The child-resistant gate latch of this invention is characterized by the fact that the locking latch is completely enclosed and therefore inaccessible when the gate latch is in the closed position. The latch control rod and its surrounding control rod enclosure tube can be varied in length so that individuals below a minimal stature cannot access the lifting tab which is positioned on the uppermost end of the vertical latch control rod where it protrudes through the upper opening of the control rod enclosure tube. Because the force of gravity upon the locking latch and the attached latch control rod are responsible for keeping the child resistant gate latch from opening when in the closed position, the required force that must be exerted upon the latching control rod in vertically upward direction is that which will exceed the combined weight of the operating components.

The inaccessibility of the latch control rod, the positive, gravity induced latching force and minimal tolerances to which the components are manufactured combine to create a child resistant gate latch which is durable and of a nature to limit access to small children thus becoming a desired alternative to gate latches which currently reside within the marketplace.

DESCRIPTION OF THE PREFERRED EMBODIMENT

This invention relates to a gate locking latch which can be raised only by vertically lifting the latch control bar. The control rod is enclosed and concealed within a tubing of sufficient length that the control rod can only be grasped by a person of sufficient size to qualify for entry to the area secured by the gate. The latch encasement likewise serves to prevent the unauthorized or unqualified entry by an individual to the area secured by the gate by the use of levers rods, wires or other mechanisms to open the latch.

Figure 1:
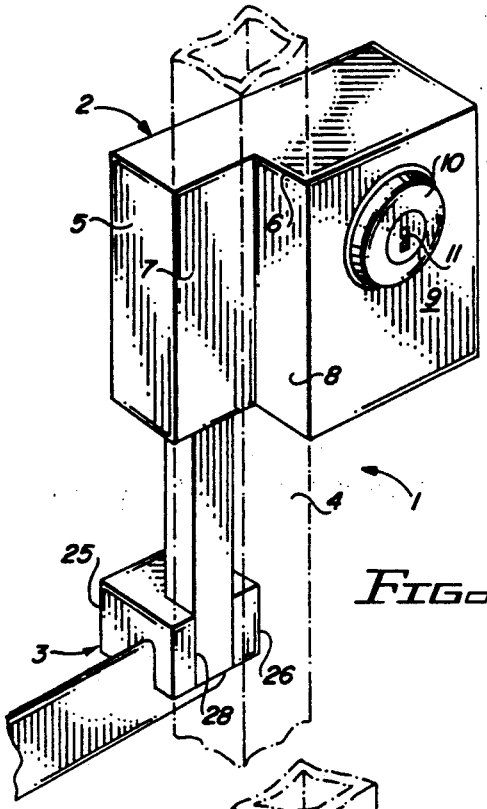
FIG. 1 is an isometric view of a new and improved, child resistant gate latch illustrating a preferred embodiment of this invention.
Figure 2:
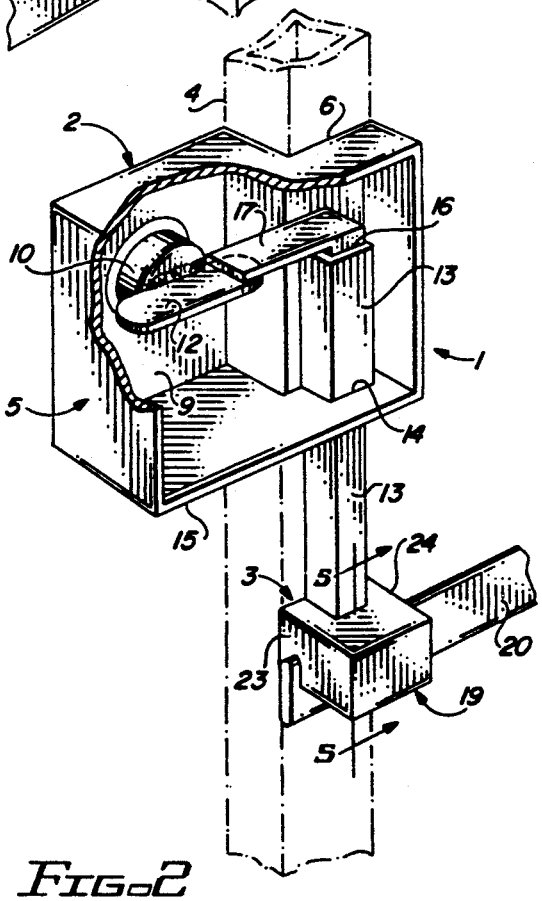
FIG. 2 is an isometric view from the rear of FIG. 1 with the back wall removed to show the inner, working mechanism.

Referring to the drawings by numerals of reference, and more particularly to FIGS. 1 and 2, there are shown front and back isometric views of a child resistant gate latch assembly 1 illustrating a preferred embodiment of the present invention. The latch assembly 1 comprises a latch operating assembly 2 and a striker bar or keeper plate assembly 3 which cooperate to perform the latching function.

The latch operating assembly 2 and striker bar or keeper plate assembly 3 are secured in vertically spaced relation on the relatively moving parts of the gate, i.e., the gate and the gate post. The latch operating assembly 2 is shown a supported on gate post 4 and striker bar or keeper plate assembly 3 is supported on the gate (not shown). The positions could be reversed and the same latching function would result. The vertical spacing of latch operating assembly 2 and a striker bar or keeper plate assembly 3 is such that the latch may be operated only by a person of sufficient height.

The latch operating assembly 2 (FIGS. 2, 3 and 4) comprises a hollow metal box 5, generally rectangular in shape, with a rectangular recess 6 having walls 7 and 8 which fit around and are secured to the gate post 4. The front wall 9 of box 5 has key assembly 10 of conventional design mounted for rotary movement therein. The outside of key assembly 1 has a key slot for receiving a key (not shown) to operate the latch. The inside of key assembly 10 has a flat operating lever 12 mounted for rotary movement to operate the latch.

A vertically-oriented, square cross-section guide tube 13 is positioned and secured in an opening 14 in bottom wall 15 of box 5. Square guide tube 13 has its top end substantially aligned with the operaing lever 12 and its bottom adjacent to striker bar or keeper plate assembly 3. A square cross-section rod 16 is positioned in and guided for vertical sliding movement in guide tube 13. The upper end of rod 16 has an operating flange 17 extending at a right angle thereto and overlying one end of operating lever 12 for operation thereby on rotation of key assembly 10 for opening the gate latch. The lower end of rod 16 has a latch member 18 secured thereon.

Figure 5:
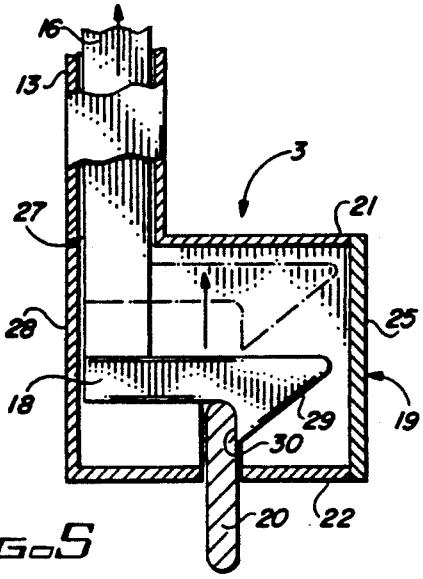
FIG. 5 is a section on the line 5—5 of FIG. 2 of the box enclosing the latch striker bar or keeper plate which secures the latch against unauthorized opening.

Striker bar or keeper plate assembly 3 (FIGS. 2 and 5) comprises a rectangular metal box 19 secured by welding or brazing on a metal striker bar or keeper plate 20 as a guard enclosure. Guard box 19 has closed top and bottom walls 21 and 22, side walls 23 and 24, and front and back walls 25 and 26. The lower end 27 of guide tube 13 terminates adjacent to or slightly above top wall 21 of guard box 19 to permit relative movement therebetween.

Striker bar or keeper plate assembly 3, comprising striker bar or keeper plate 20 and guard box 19, is secured to and supported on the gate (or post) and may be a structural member thereof. The back wall 26 of guard box 19 has an opening 28 of sufficient width to permit easy passage of rod 16 therethrough on opening and closing movement of the gate. Latch 18 is welded or brazed to the lower end of rod 16 and has an inclined surface 29 for sliding over the top edge of striker bar or keeper plate 20 and a vertical surface 30 which engages therewith in a latching relation when the gate is closed. Inclined surface 29 intersects the upper edge of the striker bar or keeper plate 20 an acute angle which angle of intersection is less than forty-five (45) degrees in the preferred embodiment. The surface 29 is inclined from the direction of rotation of a closing gate (not shown) to facilitate closing of the latch.

OPERATION

As noted above, the latch operating assembly 2 and striker bar or keeper plate assembly 3 are secured in vertically spaced relation on the relatively moving parts of the gate, i.e., the gate and the gate post. The latch operating assembly 2 is shown as supported on gate post 4 and striker bar or keeper plate assembly 3 is supported on the gate (not shown). The positions could be reversed and the same latching function would result.

The vertical spacing of latch operating assembly 2 and a striker bar or keeper plate assembly 3 is such that the latch may be operated only by a person of sufficient height. Key assembly 10 is located at a height accessable only by a person of sufficient height, viz., an adult or tall child.

The operating rod 16 and latch 18 are reciprocally movable in guide tube 13 and are lifted to open by operation of lever 12 (FIGS. 3 and 4) and closed by allowing to fall by gravity. When the gate is closed, rod 16 and latch 16 fall by gravity to the closed position hooking over striker bar or keeper plate 20.

Figure 3:
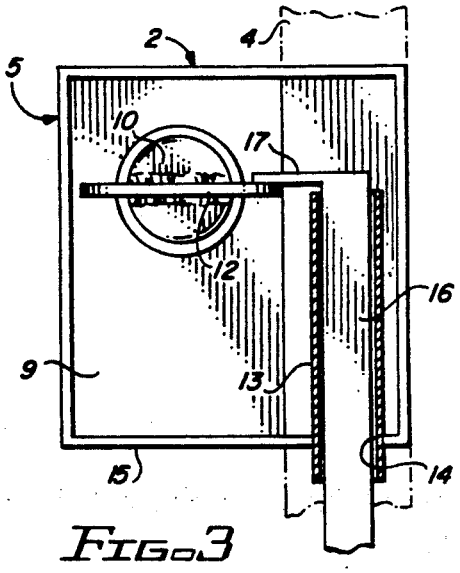
FIG. 3 is a center section of the box enclosing the latch operating mechanism and showing the mechanism in its initial unoperated position.
Figure 4:
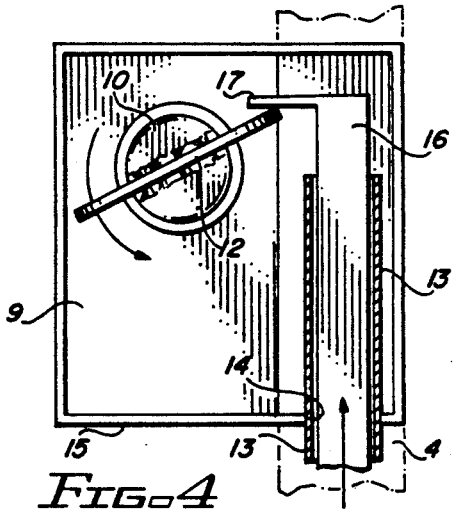
FIG. 4 is a center section, similar to FIG. 3, of the box enclosing the latch operating mechanism and showing the mechanism an operated position.

When the gate is open, rod 16 and latch 16 may be held open as in FIG. 4, or, if the key is rotated back to the position of FIG. 3, may fall by gravity to the lower position but with the guard box 19 and striker bar or keeper plate 20 moved away. In such case, on closing of the gate, the inclined surface 29 of latch 18 will slide up and over striker bar or keeper plate 20 to reach the closed position hooking over striker bar or keeper plate 20.

In order to raise the locking latch 6 sufficiently to allow the striker bar 2 to pass underneath in a horizontal direction thus opening the gate, sufficient force must be exerted vertically upward upon the latch control rod 4 overcome the force of gravity due to the weight of the latch control rod 4 and the locking latch 6.

The gate locking latch as described can be raised only by vertically lifting the latch control bar 16 and latch 18 by lever 12. The length of guide tube 13 is such that the control rod 16 can only be operated by a person of sufficient size to qualify for entry to the area secured by the gate. The guard box 19 prevents the unauthorized or unqualified entry by an individual to the area secured by the gate by the use of levers rods, wires or other mechanisms to open the latch.

While this invention hase been described fully and completely with special emphasis on a single preferred embodiment, it should be understood that within the scope of the appended claims the invention may be practiced otherwise than as specifically described.

I claim:

1. A child resistant latch for a gate and gate post comprising;

a latch operating assembly and a striker bar or keeper plate assembly, one of which is to be supported on said gate and the other of which is to be supported on said gate post, a locking latch member supported for vertical movement into and out of latching engagement with said striker bar or keeper plate, operating means interconnecting said latch operating assembly and said latch member for movement in a vertical direction, said latch operating assembly including a lever operatively engageable with said operating means interconnecting said latch operating assembly and said latch member to open and close said latch member, a key assembly for rotating said lever, said latch operating assembly and said key assembly, in use, being supported a predetermined distance above said striker bar or keeper plate assembly to permit operation only by an adult or tall child, and a guard enclosure surrounding said striker bar or keeper plate when said latch member is in latching position to prevent opening other than by said operating means.

2. A child resistant latch according to claim 1 in which said operating means comprises a reciprocally movable rod means interconnecting said latch operating assembly and said latch member for movement in a vertical direction.

3. A child resistant latch according to claim 1 in which said latch operating assembly has a guide tube extending to a point just above said guard enclosure, and said operating means comprises a reciprocally movable rod guided for movement in said tube and interconnecting said latch operating assembly and said latch member for movement in a vertical direction.

4. A child resistant latch according to claim 1 in which said latch operating assembly has a guide tube extending to a point just above said guard enclosure, said operating means comprises a reciprocally movable rod guided for movement in said tube and interconnecting said latch operating assembly and said latch member for movement in a vertical direction, and said guard enclosure has an opening for movement relative to said rod during opening and closing of said gate.

5. A child resistant latch according to claim 1 in which said operating means comprises a reciprocally movable rod means interconnecting said latch operating assembly and said latch member for movement in a vertical direction, and said latch operating assembly comprises a lever operatively engageable with said rod means on rotation to open and close said latch member.

6. A child resistant latch according to claim 1 in which said striker bar or keeper plate assembly comprises a striker bar member or keeper plate, a guard box secured on and surrounding said striker bar or keeper plate, and said latch member being movable into and out of said guard box so that in latching position opening is prevented by other than said operating means.

7. A child resistant latch according to claim 1 in which said striker bar or keeper plate assembly comprises a striker bar member or keeper plate, a guard box secured on and surrounding said striker bar or keeper plate and having an opening for movement relative to said rod during opening and closing of said gate, said latch member being movable into and out of said guard box through said opening so that in latching position opening is prevented by other than said operating means, said latch operating assembly has a guide tube extending to a point just above said guard enclosure, and said operating means comprises a reciprocally movable rod guided for movement in said tube and interconnecting said latch operating assembly and said latch member for movement in a vertical direction.

8. A child resistant latch according to claim 1 in which said striker bar or keeper plate assembly comprises a striker bar member or keeper plate, a guard box secured on and surrounding said striker bar or keeper plate and having an opening for movement relative to said rod during opening and closing of said gate, said latch member being movable into and out of said guard box through said opening so that in latching position opening is prevented by other than said operating means, said latch operating assembly has a guide tube extending to a point just above said guard enclosure, and said operating means comprises a reciprocally movable rod guided for movement in said tube and interconnecting said latch operating assembly and said latch member for movement in a vertical direction.

9. A child resistant latch according to claim 8 in which said rod member has a flange at its upper end positioned over an end of said lever and movable vertically on rotation of said lever.

10. A gate and gate post assembly with child resistant latch comprising, in combination;

a gate hinged for opening and closing movement, a gate post against which said gate closes, a latch operating assembly and a striker bar or keeper plate assembly , one of which is supported on said gate and the other of which is supported on said gate post, said latch operating assembly, in use, being supported a predetermined distance above said striker bar or keeper plate assembly to permit operation only by an adult or tall child, a locking latch member supported for vertical movement into and out of latching engagement with said striker bar or keeper plate, operating means interconnecting said latch operating assembly and said latch member for movement in a vertical direction, a guard enclosure surrounding said striker bar or keeper plate when said latch member is in latching position to prevent opening other than by said operating means, said latch operating assembly comprising a closed box having a guide tube extending to a point just above said guard enclosure, said operating means comprising a reciprocally movable rod guided for movement in said guide tube and interconnecting said latch operating assembly and said latch member for movement in a vertical direction, said latch operating assembly further comprising a lever operatively engageable with said rod on rotation to open and close said latch member, a key assembly for rotating said lever, said striker bar or keeper plate assembly comprising a striker bar member or keeper plate, said guard enclosure comprising a guard box secured on and surrounding said striker bar or keeper plate and having an opening for movement relative to said rod during opening and closing of said gate, and said latch member being movable into and out of said guard box through said opening so that in latching position opening is prevented by other than said operating means.

11. A gate and latch combination according to claim 10 in which said operating means comprises a reciprocally movable rod means interconnecting said latch operating assembly and said latch member for movement in a vertical direction.

12. A child resistant latch for a gate and gate post comprising;

a latch operating assembly and a striker bar or keeper plate assembly, one of which is to be supported on said gate and the other of which is to be supported on said gate post, said latch operating assembly, in use, being supported a predetermined distance above said striker bar or keeper plate assembly to permit operation only by an adult or tall child, a locking latch member supported for vertical movement into and out of latching engagement with said striker bar or keeper plate, operating means interconnecting said latch operating assembly and said latch member for movement in a vertical direction, a guard enclosure surrounding said striker bar or keeper plate when said latch member is in latching position to prevent opening other than by said operating means, said latch operating assembly comprising a closed box having a guide tube extending to a point just above said guard enclosure, said operating means comprising a reciprocally movable rod guided for movement in said guide tube and interconnecting said latch operating assembly and said latch member for movement in a vertical direction, said latch operating assembly further comprising a lever operatively engageable with said rod on rotation to open and close said latch member, a key assembly for rotating said lever, said striker bar or keeper plate assembly comprising a striker bar member or keeper plate, said guard enclosure comprising a guard box secured on and surrounding said striker bar or keeper plate and having an opening for movement relative to said rod during opening and closing of said gate, and said latch member being movable into and out of said guard box through said opening so that in latching position opening is prevented by other than said operating means.

* * * * *